US006102059A

United States Patent [19]

Miller

[11] Patent Number: 6,102,059

[45] Date of Patent: Aug. 15, 2000

[54] MOVABLE VEHICLE COVER

[76] Inventor: Steven M. Miller, 4422 Ferncroft Rd., Mercer Island, Wash. 98040

[21] Appl. No.: 09/111,627

[22] Filed: Jul. 7, 1998

[51] Int. Cl.[7] ..... E04H 15/00; E04H 15/46

[52] U.S. Cl. ..... 135/87; 135/141; 135/142; 135/90; 52/3; 52/66; 52/115; 52/123.1

[58] Field of Search ..... 135/87, 142, 90, 135/906, 141; 52/3, 66, 123.1, DIG. 14, 115

[56] References Cited

U.S. PATENT DOCUMENTS

| | | | |
|---|---|---|---|
| 1,114,057 | 10/1914 | Spalding . | |
| 1,780,322 | 11/1930 | Tsuji . | |
| 1,801,247 | 4/1931 | Rush . | |
| 2,082,553 | 6/1937 | Shaw et al. . | |
| 2,688,973 | 9/1954 | Reiman . | |
| 2,708,346 | 5/1955 | Smith . | |
| 2,930,387 | 3/1960 | Streich et al. . | |
| 3,077,742 | 2/1963 | Brown . | |
| 3,083,540 | 4/1963 | Smith | 114/263 |
| 3,169,644 | 2/1965 | Godbersen | 414/680 |
| 3,912,263 | 10/1975 | Yatso . | |
| 4,019,212 | 4/1977 | Downer | 114/361 |
| 4,363,284 | 12/1982 | Monroe . | |
| 4,683,902 | 8/1987 | Wilson . | |
| 5,419,273 | 5/1995 | Cutler . | |
| 5,458,079 | 10/1995 | Matthews et al. | 114/351 |
| 5,573,026 | 11/1996 | Griffith . | |
| 5,593,239 | 1/1997 | Sallee | 403/109 |
| 5,595,204 | 1/1997 | Hwang | 135/142 |
| 5,692,857 | 12/1997 | Ness | 405/3 |

OTHER PUBLICATIONS

Basta Marine, Inc., Bellevue, Washington, (Sales Brochure) 1994.

*Primary Examiner*—Christopher T. Kent
*Assistant Examiner*—Jennifer I. Thissell
*Attorney, Agent, or Firm*—Seed IP Law Group PLLC

[57] ABSTRACT

A movable device for alternatingly covering and uncovering a vehicle is shown and described. The device includes a protective cover, a structural member, a lift member, and an inlet for receiving a pressurized fluid and controlling the fluid to raise and lower the cover. The protective cover is constructed to receive at least a portion of the vehicle, such as a boat or a car. The structural member has an elongated hollow extending at least partially from a first end to a bottom end and ending at a termination point. A first end of the lift member is coupled to the protective cover and a second end of the lift member is reciprocally engaged with the hollow. The lift member can move with the protective cover between a first position in which the protective cover receives at least a portion of the vehicle and a second position in which the protective cover is separated from the vehicle. The space between the second end of the lift member and the termination point of the hollow defines a chamber. The inlet communicates with a source of pressurized fluid and the chamber and controls the pressurized fluid to move the lift member between the first position and the second position.

25 Claims, 7 Drawing Sheets

MOVABLE VEHICLE COVER

TECHNICAL FIELD

The present invention relates to covers, covering devices and methods for covering objects. More particularly, the present invention relates to movable covering devices for covering objects such as vehicles and for protecting the objects from rain, dirt and other elements.

BACKGROUND OF THE INVENTION

Vehicles, such as boats and cars, are often left outdoors between uses. These periods, during which the vehicle is exposed to the elements, can sometimes be a considerable length of time. As a result, the vehicle may get wet, dirty or damaged. Open-top boats and convertible cars, for example, are susceptible to damage from any type of precipitation. Precipitation can get the upholstery and carpeting wet, making it uncomfortable to drive and possibly resulting in mildew or related damage. Hail or other wind-borne particles can damage a vehicle's exterior. Also, extended exposure to ultraviolet rays or oxidation can damage a vehicle's finished surfaces.

To protect vehicles from dirt and damage, a number of vehicle covers have been developed. The most common vehicle cover is a loose blanket or tarp that is placed on top of the vehicle. These covers are often waterproof to protect the vehicle from damage caused by wetness. To install these blanket-type covers, the cover is first unrolled, or un-wadded, and laid over the top of the vehicle. Because the cover is pliable, it generally conforms to the shape of a top surface of the vehicle. Cords or other attachment members are then used to retain the cover in place. On windy days, however, blanket-type covers are often blown off of the vehicle. After being blown off, the cover no longer protects the vehicle from the elements, and the cords or cables once used to hold the cover in place may rub against the vehicle and cause additional damage. Also, after being blown onto the ground, the cover can become dirty. Dirt entrained in the cover can scratch the vehicle's surface as wind shifts the cover.

In an attempt to solve one or more of the above problems, rigid and semi-rigid covers have developed. Covers having rigid elements, however, are often too cumbersome or heavy to install by hand and, therefore, either go unused or can only be used with some type of carrying mechanism. Examples of rigid or semi-rigid vehicle covers incorporating carrying mechanisms include: U.S. Pat. No. 2,688,973 to Reiman; U.S. Pat. No. 4,019,212 to Downer; U.S. Pat. No. 4,363,284 to Monroe; and U.S. Pat. No. 4,683,902 to Wilson. All of these designs incorporate mechanical pulleys, gears, winches, ropes, or equivalent mechanisms to manually lift the protective cover off of the vehicle. Manually lifting a vehicle cover, even using pulleys or gears, can be difficult for some individuals. As the gears and pulleys are exposed to the elements, they may become rusty or damaged, making them even more difficult to operate.

Mechanical winches and electric motors can be substituted to power the winch or pulley system. Mechanical and electrical motors, however, are expensive to purchase, difficult to install and adjust, and difficult to maintain or move once installed. Long term exposure to the elements can damage motors, requiring expensive repairs or replacement. Also, vehicle covers used in remote or special places make using a power motor especially difficult. For example, storing a car at a substantial distance from a house requires the use of long extension cords, which can be unsightly or dangerous. Covering a boat in a slip can be even more problematic. Docks often do not have electrical outlets. As a result, extension cords must be used to power an electric motor. In addition to the problems discussed above, using an extension cord near a body of water is particularly dangerous due to risks associated with electrocution.

SUMMARY OF THE INVENTION

The present invention relates to movable covering devices for covering objects such as vehicles and for protecting the vehicles from rain, dirt and other elements. Under one aspect of the invention, the covering device can move between a first, or lowered, position in which the cover receives at least a portion of the vehicle to protect the vehicle from the elements, and a second, or raised, position in which the vehicle can be moved to or from the device. The covering device includes a protective cover, a structural member, a lift member, and an inlet for receiving and controlling a pressurized fluid.

The protective cover has a lower surface constructed to receive at least a portion of the vehicle. The cover may be fabricated from any material that prevents dirt, rain and other elements from entering the covered portion of the vehicle. The cover can be flexible or rigid, and can be formed to receive virtually any vehicle, including a boat or a car. In a preferred embodiment, the protective cover has a rigid, light-weight frame and a pliable cover. The frame is formed to closely receive the top portion of the vehicle, and the pliable cover is fixed to the frame.

The structural member retains the covering device in the proper position for use. The structural member includes a first, or top, end and a second, or bottom, end. The top end has an elongated hollow extending at least partially from the top end toward the bottom end and ending at a termination point. The hollow preferably has a circular cross-section.

The lift member is an elongated member having a first, or top, end and a second, or bottom, end. The top end of the lift member is coupled with the protective cover. The top end can be attached directly to the protective cover, or can be coupled to the protective cover with adjustable connectors to allow the relative position of the protective cover with respect to the lift member to be adjusted to conform to a particular vehicle. The bottom end of the lift member has an external shape that is complementary to the internal wall of the hollow and that is reciprocally engaged with the hollow. The portion of the hollow that lies between the bottom end of the lift member and the termination point of the hollow defines a chamber. The lift member moves with the protective cover along a reciprocal path between the lowered position and the raised position.

The inlet for receiving pressurized fluid communicates with the chamber by hoses, tubing or other suitable connectors. In one embodiment, the pressurized fluid is water. The pressurized fluid is controlled to move the lift member between the lowered position and the raised position to alternatingly cover and uncover the vehicle. When the pressurized fluid is directed into the chamber, the force generated by the fluid against the lift member causes the protective cover to move toward the raised position. When the flow of pressurized fluid stops, the lift member remains stationary, allowing the vehicle to be moved into and out of the zone of the protective cover. When the protective fluid is discharged from the chamber, the protective cover moves toward the lowered position.

DETAILED DESCRIPTION OF THE INVENTION

The present invention generally relates to movable covering devices for protecting an object, such as a vehicle. The covering devices use a pressurized fluid to raise a protective cover from a first, or lowered, position in which the protective cover receives at least a portion of the vehicle to protect it from the elements, to a second, or raised, position in which the vehicle may be moved to and from the covering device. Many specific details of certain embodiments of the invention are set forth in the following description and in FIGS. 1–8 to provide a thorough understanding of such embodiments. One skilled in the art, however, will understand that the present invention may have additional embodiments, or that the invention may be practiced without several of the details described in the following description.

Figure 1:
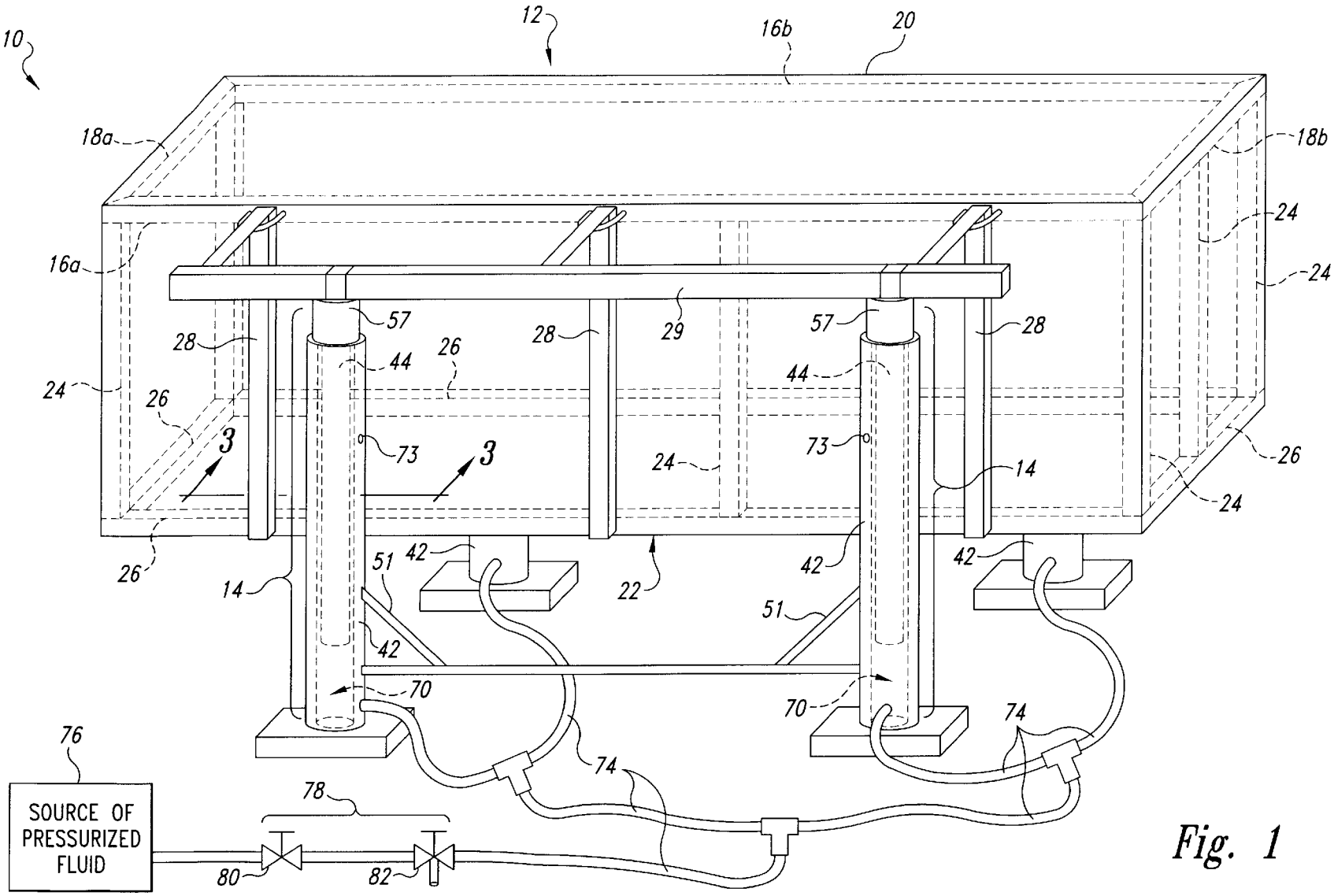
FIG. 1 is a front isometric view of a movable vehicle cover configured in a lowered position according to one embodiment of the present invention.
Figure 5:
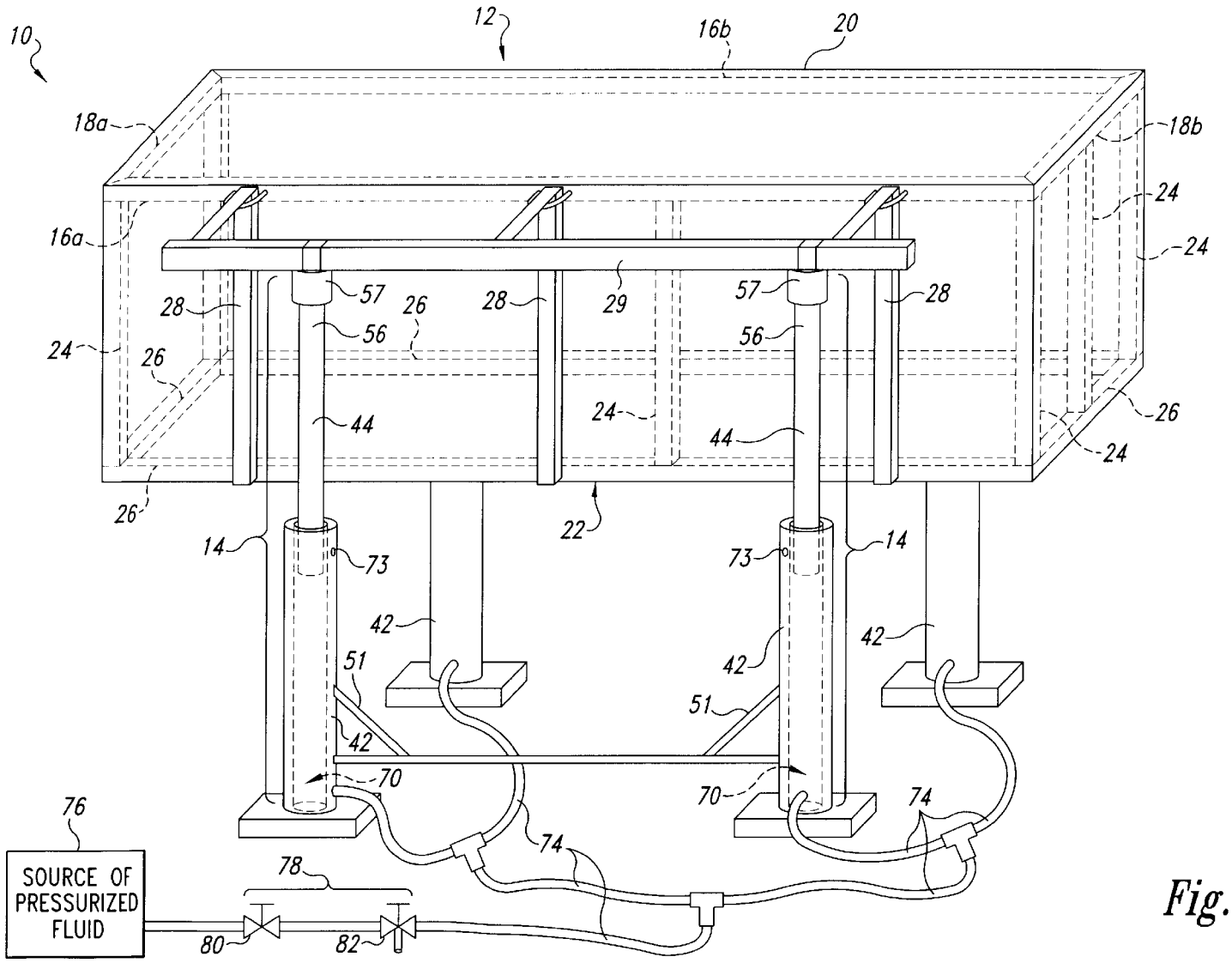
FIG. 5 is an isometric view of the movable vehicle cover of FIG. 1 configured in a raised position.

FIG. 1 shows a vehicle covering device 10 according to one embodiment of the present invention. The vehicle covering device 10 includes a protective cover 12 coupled to four pistons 14. The pistons 14 move with the protective cover 12 between the lowered and raised positions. The covering device 10 in the raised position is illustrated in FIG. 5.

The protective cover 12 includes at least two lengthwise frame members 16*a* and 16*b*, two crosswise frame members 18*a* and 18*b* (both shown in broken lines), and a protective barrier 20. The lengthwise frame members 16*a*, 16*b* can be oriented to be generally parallel with the length of the vehicle. In the illustrated embodiment, the lengthwise frame members 16*a*, 16*b* are at least substantially linear, although they can also be curved to conform with one of the longitudinal sides of the vehicle. The lengthwise frame members 16*a*,16*b* can be positioned near, and on opposite sides of the vehicle. The crosswise frame member 18*a* extends between a first end of the lengthwise frame members 16*a*,16*b*, while the crosswise frame member 18*b* extends between a second end of the lengthwise frame members 16*a*,16*b* opposite the first end. While the crosswise frame members 18*a*,18*b* are shown oriented perpendicular to the lengthwise frame members 16*a*,16*b* they can be oriented oblique thereto. Additional crosswise frame members can also be positioned intermediate the length of the lengthwise support members 16*a*,16*b* to add additional structural strength to the protective cover 12. The lengthwise and crosswise frame members 16*a*,16*b* and 18*a*,18*b* can be fabricated from a rectangular aluminum frame member, polyvinyl chloride ("PVC") tubing, or any suitable equivalent having appropriate structural rigidity.

The protective barrier 20 is attached to the lengthwise and crosswise frame members 16*a*,16*b* and 18*a*,18*b*. In the illustrated embodiment, the protective barrier 20 is a pliable sheet of waterproof fiber, such as a vinyl-coated mesh or another suitable material. The material of the protective barrier 20 can be stretched to closely conform with the exterior shape of the frame members 16,*a*,16*b* and 18*a*,18*b* or it can be suspended by straps, ties or similar elements from the frame members. The protective barrier 20 has a lower surface 22 that is constructed to receive at least a portion of a top surface of the vehicle (not shown) when the protective cover 12 is lowered onto the vehicle. The protective barrier 20 can also be manufactured from a substantially rigid material, such as a carbon-fiber or fiberglass matrix composite. In such a case, the protective barrier 20 may be rigid enough to avoid the need for any frame members.

The protective cover 12 may also include one or more upright frame members 24 rigidly engaged with one of the lengthwise or crosswise frame members 16*a*,16*b*, and 18*a*, 18*b*. In the illustrated embodiment, the upright frame members 24 are spaced apart along the lengthwise and crosswise frame members 16*a*,16*b*, and 18*a*,18*b* in order to make the protective cover 12 more stable. The upright frame members 24 can be fabricated from a rectangular aluminum frame member, PVC tubing, or any suitable equivalent.

The protective cover 12 may also include lower frame members 26 positioned near the lower surface 22 of the protective barrier 20. The lower frame members 26 may define the shape of the lower surface 22 such that the lower surface 22 closely receives the sides of the vehicle.

Figure 2:
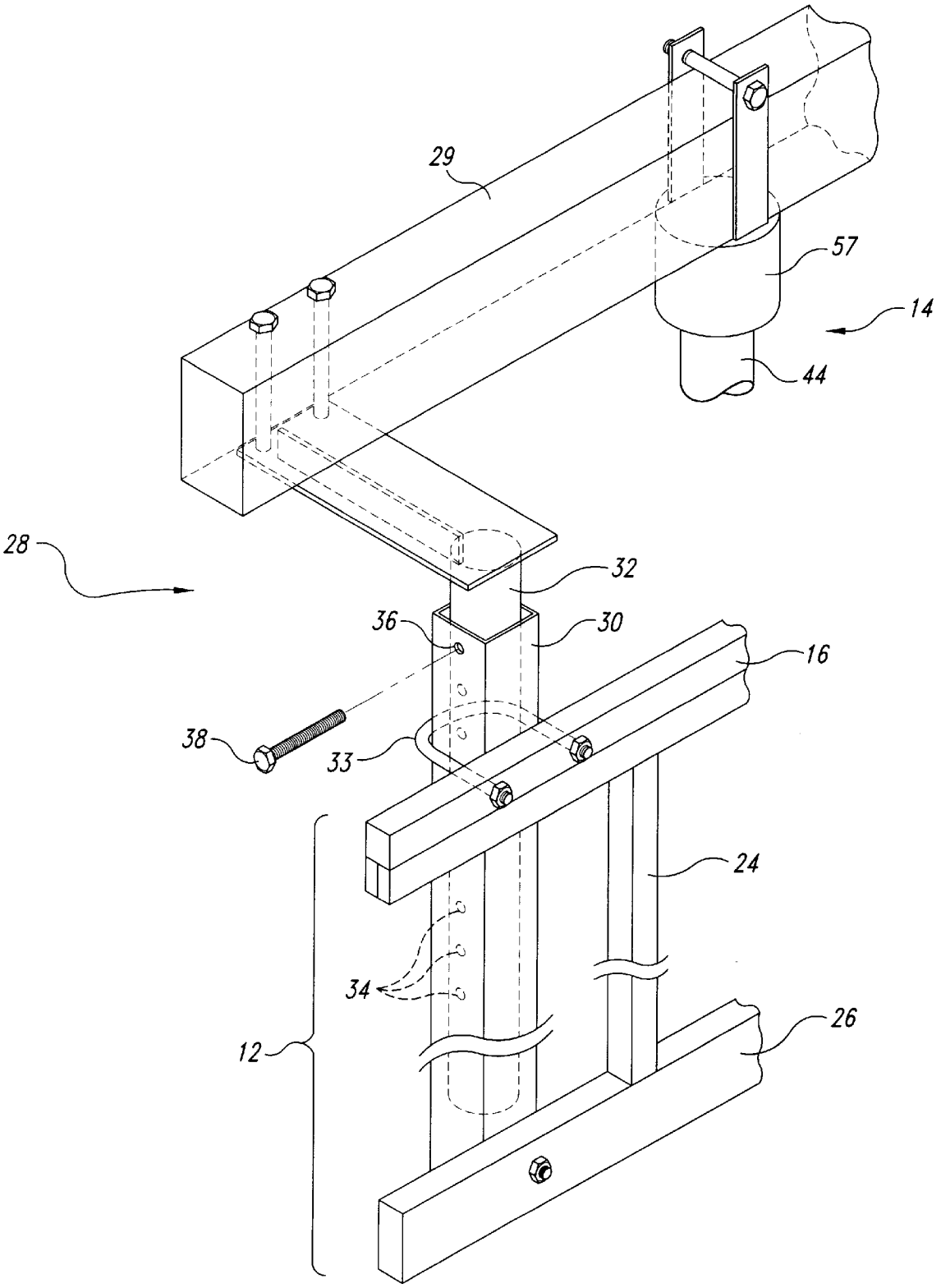
FIG. 2 is a rear isometric view of a portion of the movable cover of FIG. 1.

Each pair of the pistons 14 is coupled to the protective cover 12 by three spaced-apart, adjustable connecting assemblies 28 and one elongated support member 29. The elongated support member 29 couples the connecting assemblies 28, positioned along either side of the protective cover 12, with the pistons 14. As illustrated in FIG. 2, the connecting assembly 28 has a first attachment member 30 and a second attachment member 32 slidably engaged with, and adjustable with respect to, the first attachment member 30 to adjust the relative position of the protective cover 12 with respect to the pistons 14. The connecting assembly 28 can be fabricated from aluminum, or any other suitable material. The first attachment member 30 is coupled to the protective cover 12 by a fastener 33. In the illustrated embodiment, the fastener 33 is a U-bolt encircling the first attachment member 30 and engaging the lengthwise frame member 16. The second attachment member 32 is rigidly coupled to the elongated support member 29.

The second attachment member 32 has several first engagement sites 34 spaced along its length. The first attachment member 30 has a second engagement site 36 positioned to align with any one of the first engagement sites 34 at a number of positions. A locking member 38 can be engaged with the first engagement site 34 and the second engagement site 36 to retain the connection assembly 28 in a selected position. In the illustrated embodiment, the first and second engagement sites 34,36 are apertures and the locking member 38 is a complementary shaft. The locking member 38 can be a bolt, a dowel, or any other suitable member.

Figure 4:
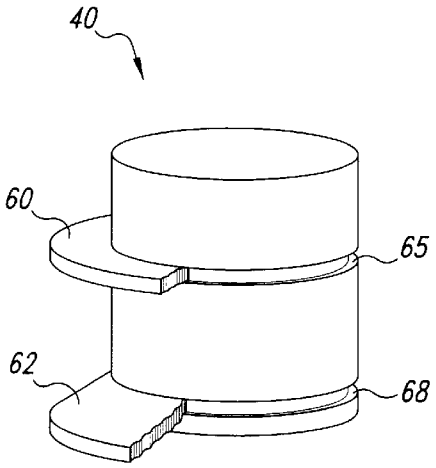
FIG. 4 is a partially cut-away isometric view of a portion of the movable vehicle cover of FIG. 1.
Figure 3:
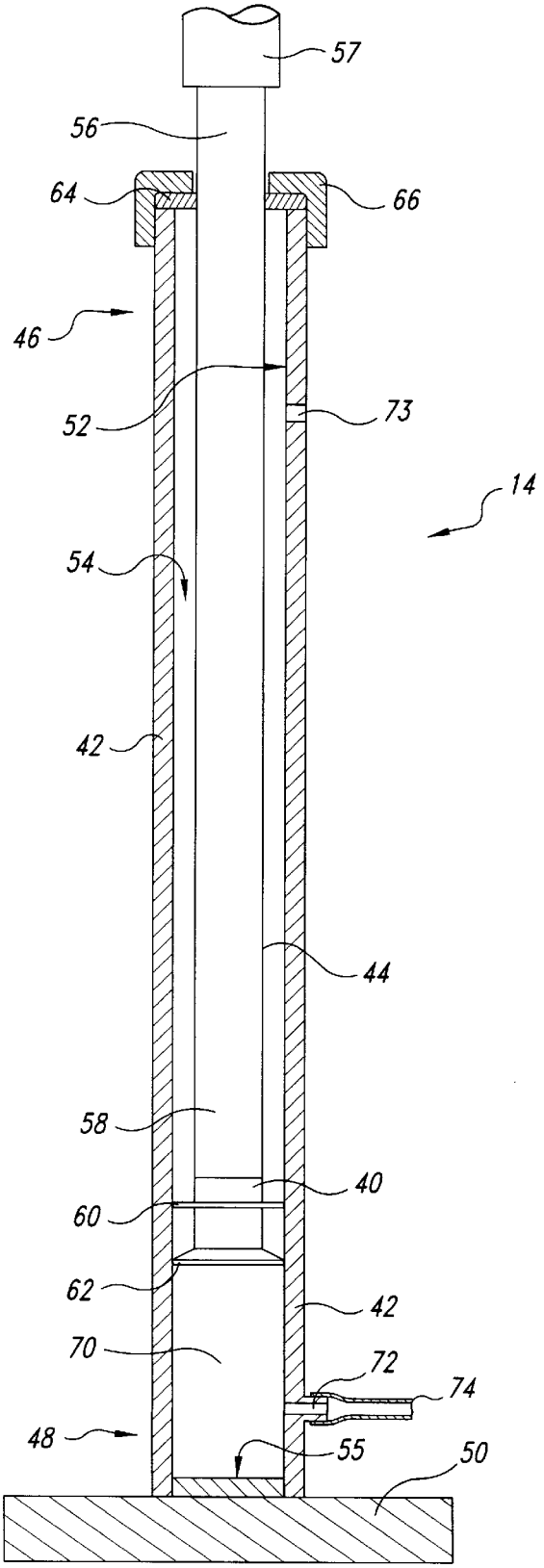
FIG. 3 is a cut-away front elevation view of a portion of the movable vehicle cover of FIG. 1 according to section 3—3 configured in a position intermediate the lowered and raised positions.

FIGS. 3 and 4 illustrate the piston 14 and a piston head 40, respectively, according to one embodiment of the present invention. The piston 14 includes a structural member 42 and a lift member 44 reciprocally engaged with the structural member 42. The structural member 42 in the illustrated embodiment is an elongated tube having a first, or top, end 46 and a second, or bottom, end 48. The structural member 42 can be fabricated from a rigid material, such as PVC, or from any suitable material.

The bottom end 48 of the structural member 42 is attached to a base 50 sized and shaped to retain the piston 14 in a stable position. The base 50 can also be mounted to a structure, such as a dock, or can be secured to the ground, such as by a foundation. A diagonal-member 51 (FIG. 1), such as a bar or cable, can be attached to the base 50 or a low point on the structural member 42 to strengthen the piston 14 in a lateral direction.

The top end 46 of the structural member 42 has an inner wall 52 defining an elongated hollow 54 that extends longitudinally generally along the center of the structural member 42 from the top end 46 toward the bottom end 48 and terminates at a termination point 55. In the illustrated embodiment, the hollow 54 extends along substantially the entire length of the structural member 42. The inner wall 54 has a cross-sectional shape substantially constant along the entire length of the hollow 54. In the illustrated embodiment, the hollow 54 has a circular cross-section.

The lift member 44 is reciprocally engaged with the structural member 42 such that the piston 14 can telescope between the raised and lowered positions. The lift member 44 has a first, or top, end 56 and a second, or bottom, end 58 opposite the top end 56. The lift member 44 is narrower than the hollow 54 to allow the lift member 44 to slide longitudinally within the hollow 54 with little or no resistance. A first cap 57 is attached to the top end 56 of the lift member 44. As illustrated in FIG. 1, the first cap 57 at the top end 56 of each lift member 44 is coupled near a corresponding end of one elongated support member 29.

The bottom end 58 of the lift member 44 terminates in a piston head 40. The piston head 40 can be an integral part of the lift member 44, or it can be a separate element fixed to the terminal end of the lift member 44. In the illustrated embodiment, the piston head 40 is a right cylinder machined from PVC and having an outside diameter slightly smaller than the inside diameter of the hollow 54.

The piston head 40 has a first ring 60 and a second ring 62. The first ring 60 is fixed at a point central along the length of the piston head 40, and has an outside diameter approximately equal to the inside diameter of the hollow 54 to retain the piston head 40 in a central position with respect to the hollow 54. The first ring 60 can be fixed to the piston head 40 by a first groove 65 formed circumferentially around an outside surface of the piston head 40, or by any other suitable means. A third ring 64 (FIG. 3) is retained by a second cap 66 at the top end 46 of the structural member 42 to retain the lift member 44 in a central position with respect to the hollow 54. The first ring 60 and the third ring 64 combine to retain the lift member 44 and the piston 40 in the proper axial orientation with respect to the structural member 42 regardless of the linear position of the lift member 44. When the lift member 44 is in the lowered position, the first cap 57 contacts the second cap 66, and the second cap 66 obstructs the path of the first cap 57 such that the lift member 44 cannot move further downward. The first and third rings 60,64 are fabricated from a material that allows the lift member 44 to slide with reduced friction. In the preferred embodiment, the first and third rings 60,64 can be manufactured from TEFLON or a suitable equivalent.

The second ring 62 is preferably fixed within a second groove 68 formed circumferentially around an outside surface of the piston head 40 near a lowermost point along the length of the piston head 40. The second ring 62 is fabricated from a resilient material, such as rubber. The second ring 62 has an outside diameter slightly larger than the inside diameter of the hollow 54 so that the second ring 62 maintains constant contact with the entire perimeter of the inner wall 52. The second ring 62 thus acts as a seal to prevent fluid from passing between the piston head 40 and the inner wall 52.

The space between the piston head 40 and the termination point 55 of the hollow 54, and lying within the inner wall 52 of the hollow 54, defines a chamber 70. The volume of the chamber 70 changes with the reciprocal movement of the lift member 44. As the lift member 44 slides upward, the chamber 70 increases in volume, and as the lift member 44 slides downward, the chamber 70 decreases in volume.

At a point near the termination point 55 of the hollow 54, the structural member 42 has a port 72 extending through the structural member 42 and into the chamber 70. An opening 73 is located at a point near the top end 46 of the structural member 42, and extends through the wall of the structural member 42 into the hollow 54 to allow water to escape from the chamber 70 when the piston 14 has reached its uppermost position. A tubing assembly 74 couples each of the pistons 14 to a source of pressurized fluid 76 (FIG. 1). The tubing assembly 74 attaches to each of the pistons at the port 72. In the exemplary embodiment, the source of pressurized fluid 76 is a water faucet.

Referring back to FIG. 1, a valving assembly 78 is positioned between the source of pressurized fluid 76 and the tubing assembly 74 to control the pressurized fluid. The valving assembly 78 includes an inlet valve 80 and a discharge valve 82. The inlet valve 80 controls the flow of pressurized fluid between the source 76 and the pistons 14. The discharge valve 82 controls the flow of fluid between the pistons 14 and a drain or other discharge location. When the inlet valve 80 is in an open position and the discharge valve 82 is in a flow-through position, the pressurized fluid fills the chambers 70. When the inlet valve 80 is closed and the discharge valve 82 is in the flow-through position, the volume of fluid in the chambers 70 remains constant. When the inlet valve 80 is closed and the discharge valve 82 is in a discharge position, the fluid drains from the chambers 70 of the pistons 14. The inlet valve 80 and the discharge valve 82 can also be configured as a single valve. In the preferred embodiment, a hose and hose coupling are used to couple the inlet valve 80 with a standard faucet. The inlet valve 80 can also be permanently coupled to the water supply by tubing or piping.

During operation, the covering device 10 can initially be in the lowered position. In this position, the first cap 57 is in contact with the second cap 66 and the piston head 40 is positioned above the port 72. With the discharge valve 82 in the flow-through position, the inlet valve 80 is opened to allow pressurized fluid to flow through the tubing assembly 74 and into the chambers 70. The pressure in each chamber 70 increases to a point where the force exerted on the piston 40 in an upward direction is greater than the weight of the protective cover 12, the connecting assemblies 28, and the elongated support members 29. Depending on the number of pistons 14, varying weight can be supported by each piston 14. In the illustrated embodiment, four pistons 14 are used to raise the protective cover 12. With additional pistons 14 or other configurations, a heavier protective cover 12 could be raised.

As the chambers 70 fill and force the pistons 14 upward, the protective cover 12 moves toward the raised position. If a piston 14 moves beyond the opening 73 in the wall of the structural member 42, the water entering the chamber 70 escapes through the opening 73. This diversion of flow drops the pressure in the water to a point where the pistons 14 no longer move in an upward direction. The stroke of the protective cover 12 is great enough that the vehicle can be removed from under the protective cover 12 when the piston 14 is in the raised position. The piston 14 can also be stopped by closing the inlet valve 80. Once the inlet valve 80 is closed, the water stops entering the chamber 70, and the piston 14 stops moving. FIG. 5 illustrates a covering device 10 according to this particular embodiment in the raised position.

To lower the protective cover 12, the inlet valve 80 is closed and the discharge valve 82 is moved to the discharge position. The gravitational force exerted on the fluid in the chambers 70 by the pistons 40 causes the water to flow from the chambers 70 and out of the discharge valve 82. As the water flows out of the chambers 70, the pistons 40 and the protective cover 12 move downward. The protective cover 12 descends until either the protective cover 12 contacts the top surface of the vehicle or until the first cap 57 contacts the second cap 66. A physical stop can also be incorporated into the piston 14 to stop the lift member 44 in the raised or lowered position, or an intermediate position.

The preferred embodiment of the covering device 10 provides several advantages for covering the vehicle. For example, because the covering device 10 is coupled to the protective cover 12, an individual does not need to remove the cover by hand and does not need to store the cover. Instead, the protective cover 12 is raised above the vehicle automatically, and the vehicle is merely moved out from under the protective cover 12. The protective cover 12 can be stored in the raised or lowered position.

Another advantage of this embodiment of the present invention is that it automatically raises the protective cover 12 without the use of cables, ropes, pulleys or winches. Because this embodiment of the present invention can be fabricated from PVC and is operated by pistons, there is no need for cables, pulleys or gears exposed to the weather to rust. The piston head 40 and the associated working parts are contained within the structural member 42 and protected from the elements.

Yet another advantage of this embodiment is the fact that the power for the covering device 10 does not use expensive or complicated pumps, motors or generators. Instead of using a motor or similar device that is expensive to purchase and maintain, this embodiment of the present invention can operate on pressurized water from a common faucet. The covering device 10 can be merely coupled to a water faucet and operated quickly and easily.

Figure 6:
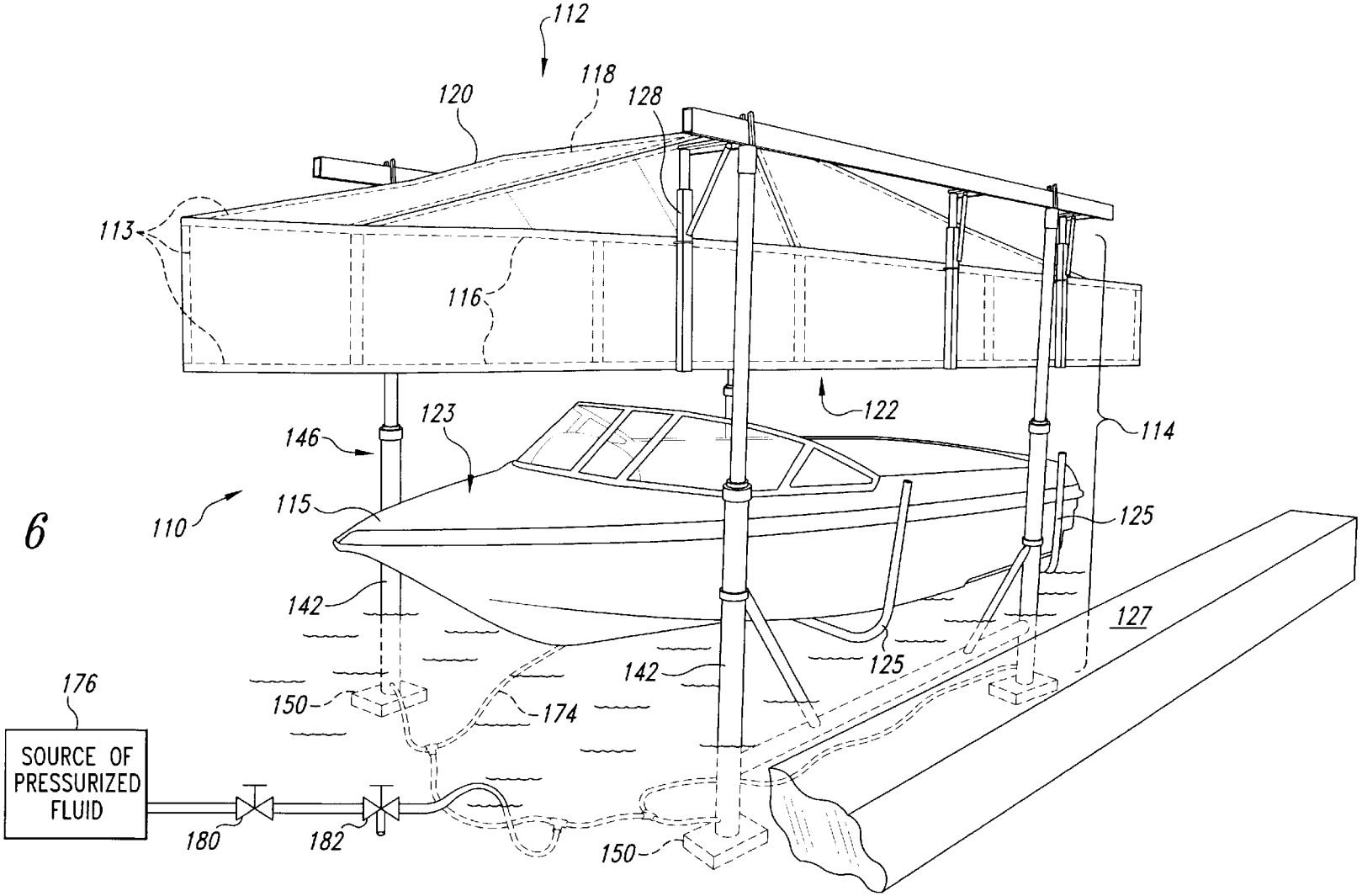
FIG. 6 is an isometric view of another movable vehicle cover configured in the raised position according to another embodiment of the present invention.
Figure 7:
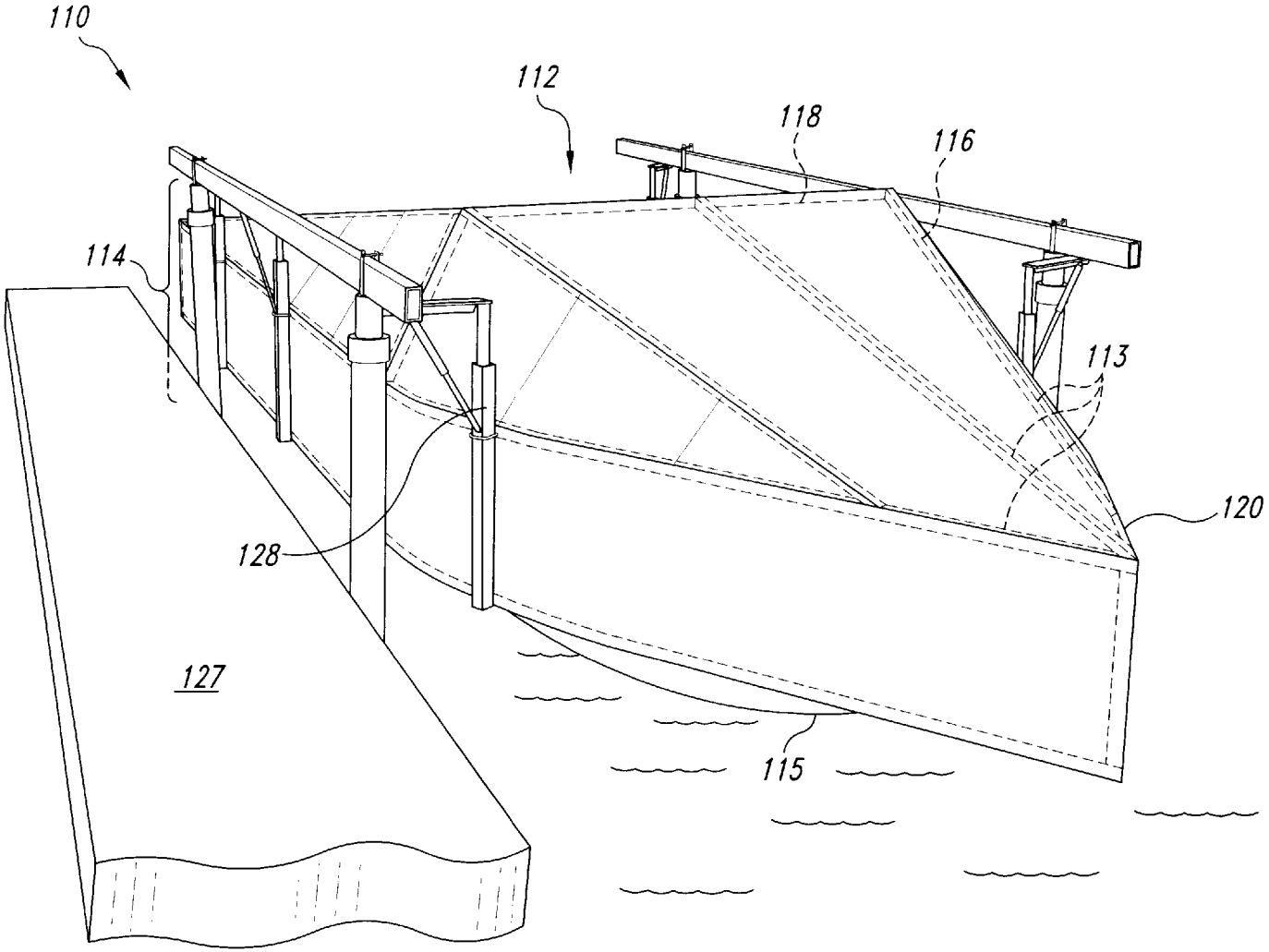
FIG. 7 is an isometric view of the movable vehicle cover of FIG. 6 configured in the lowered position.

FIGS. 6 and 7 illustrate another covering device 110 according to another embodiment of the present invention. The covering device 110 includes a protective cover 112 and one or more pistons 114. The protective cover 112 has a rigid sub-frame 113 and a protective barrier 120 constructed to closely receive an upper surface 123 of a boat 115. The sub-frame 113 comprises a plurality of lengthwise frame members 116 and crosswise frame members 118. The protective cover 112 has a lower surface 122 complementary to the upper surface 123 of the boat 115. The protective barrier 120 is stretched tightly and fixed to the sub-frame 113.

The covering device 110 of this embodiment functions substantially the same as that described above, however, this covering device 110 can be configured to cover the boat 115 while in the water. The structural members 142 may be designed to be set onto the bottom surface of a lake or similar body of water, or can be mounted to a dock 127 or similar structure. The bases 150 of the structural members 142 can be weighted to sink to the bottom of the water and rest on the bottom. The top ends 146 of the structural members 142 project above the surface of the water. Because the tubing assembly 174 is water-tight, it can be fully submerged and not adversely affect the functioning of the covering device 110. The inlet valve 180 and the discharge valve 182 can be positioned on the dock 127 or in another suitable place.

When the covering device 110 is in the lowered position, as illustrated in FIG. 7, the protective cover 112 closely receives the top surface of the boat 115. The adjustable connecting assembly 128 can be adjusted to receive either a boat 115 floating on the surface of the water or a boat 115 retained in a boat lift 125 (FIG. 6) above the surface of the water. When the covering device 110 is moved into the raised position, as illustrated in FIG. 6, the protective cover 112 is separated from the boat 115 by a great enough distance to move the boat to and from the covering device 110.

Figure 8:
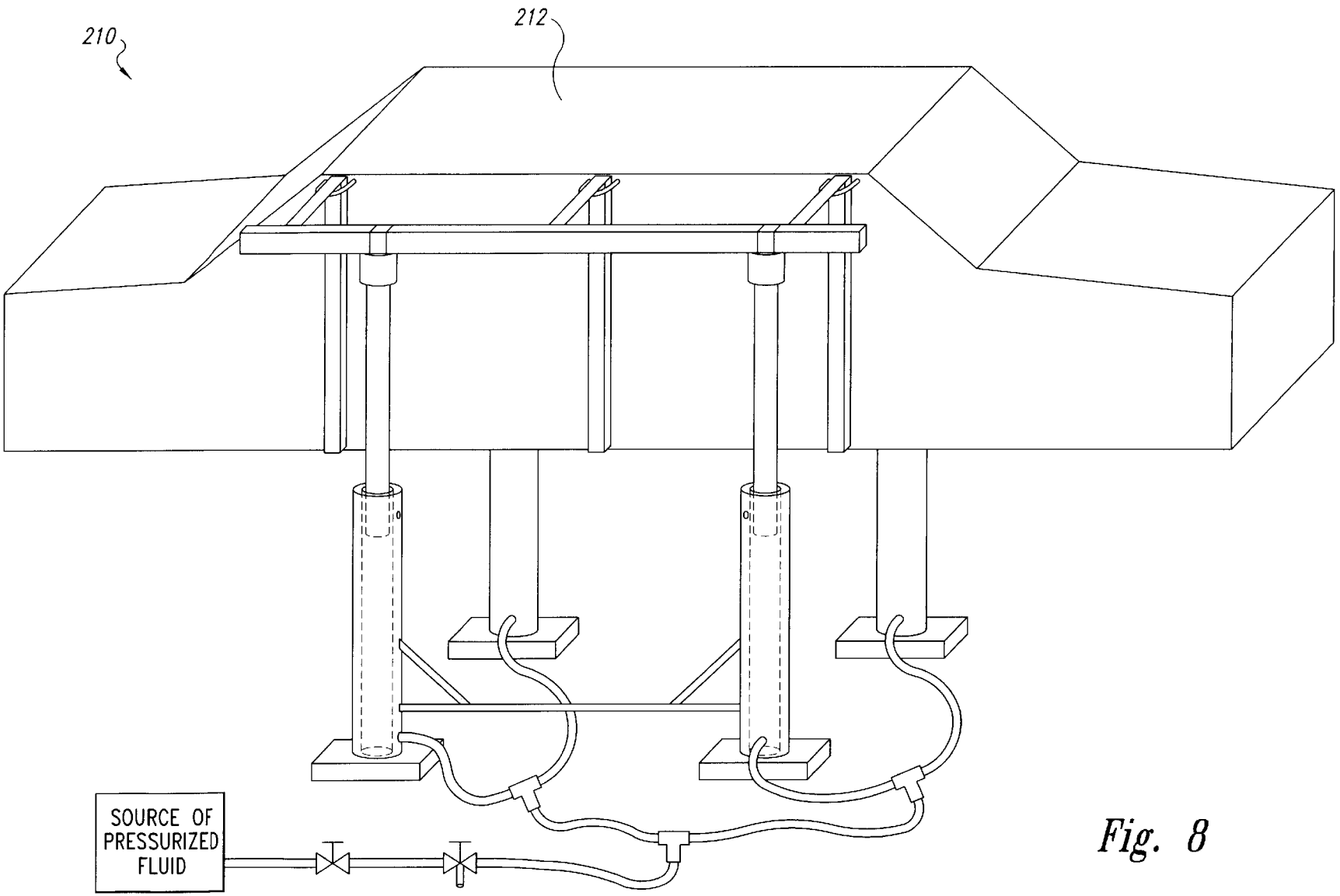
FIG. 8 is an isometric view of yet another movable vehicle cover configured in the raised position according to yet another embodiment of the present invention.

FIG. 8 illustrate yet another covering device 210 according to yet another embodiment of the present invention. In this embodiment, the protective covering 212 is constructed to closely receive the top portion of an automobile (not shown). The covering device 210 otherwise functions the same as the embodiments described above.

From the foregoing it will be appreciated that, although specific embodiments of the invention have been described herein for purposes of illustration, various modifications may be made without deviating from the spirit and scope of the invention. For example, the protective cover 12 need not be raised vertically. Instead, the pistons 14 can be slanted and raise the protective cover 12 along a diagonal line. Also, the pistons may be positioned along one side of the vehicle, with hinges on the opposite side so that the protective cover 12 is rotated away from the vehicle.

Aspects of the present invention can be applied to any type of vehicles, such as boats and cars. For example, the structural member can be set directly on the ground or on the bottom of a body of water, or it can be secured to a foundation, a dock, or an outside wall of a structure (e.g., a garage). The present invention can also be used to protect patio furniture, hot tubs or other objects.

These and other changes can be made to the invention in light of the above detailed description. In general, in the following claims, the terms used should not be construed to limit the invention to the specific embodiments disclosed in the specification and the claims, but should be construed to include all covering devices that operate under the claims to provide a device for alternatingly covering and uncovering an object. Accordingly, the invention is not limited by the disclosure, but instead its scope is to be determined entirely by the following claims.

I claim:

1. A device for covering a vehicle, the device comprising:

a protective cover;

a structural member having first and second ends, the first end having an elongated hollow extending at least partially from the first end to the second end and ending at a termination point, the hollow having an inlet for receiving a pressurized fluid and an imperforate, internal wall at least proximate the inlet;

an elongated lift member having first and second ends, the first end of the lift member being coupled with the protective cover, the second end of the lift member having an external shape complementary to the internal wall of the hollow and being closely received by the hollow to define a chamber between the second end of the lift member and the termination point of the hollow, the chamber being at least substantially separated from an external environment by the cooperation of the second end of the lift member, the terminal end of the hollow, and the imperforate, internal wall, the lift member being reciprocally movable with the protective cover between a first position in which the protective cover is proximate at least a portion of the vehicle and a second position in which the protective cover is spaced apart from the vehicle; and a control device in fluid communication with the inlet and the chamber, the control device being controllable to direct the pressurized fluid into the chamber to move the lift member from the first position to the second position, and controllable to direct the pressurized fluid out of the chamber to move the lift member from the second position to the first position.

2. The device of claim 1 wherein the protective cover further comprises a rigid frame and a pliable sheet, the rigid frame being constructed to closely receive at least a portion of the vehicle, and the pliable sheet being attached to the rigid frame to protect the vehicle when the lift member is in the first position.

3. The device of claim 1 wherein the protective cover further comprises a rigid frame and a pliable sheet, the rigid frame being constructed to closely receive at least a portion of a top of a boat, and the pliable sheet being attached to the rigid frame to protect the boat when the lift member is in the first position.

4. The device of claim 1 wherein the structural member contacts the ground.

5. The device of claim 1 wherein the structural member is coupled to a docking structure for a boat and the protective cover is constructed to receive at least a portion of the boat.

6. The device of claim 1 wherein the structural member is constructed to rest on a bottom of a body of water and the protective cover is constructed to receive at least a portion of a boat.

7. The device of claim 1 further comprising a boat lift for raising a boat from a body of water, the structural member being coupled to the boat lift and the protective cover being constructed to receive at least a portion of the boat.

8. The device of claim 1 wherein the hollow extends in a downward direction during operation.

9. The device of claim 1 wherein the hollow has a cylindrical cross-section.

10. The device of claim 1 wherein the inlet is configured to be selectively coupled to a water faucet such that the device operates using pressurized water.

11. A device for using a source of pressurized fluid to move a vehicle cover, the device comprising:

a structural member having an internal chamber and an inlet in fluid communication with the internal chamber;

a lift member having first and second ends, the first end of the lift member being coupled to the protective cover, the second end of the lift member being reciprocally engaged with the internal chamber of the structural member, the internal chamber being at least substantially separated from an external environment, the lift member being movable with the vehicle cover between a first position in which the device is configured to position the vehicle cover in proximity with a vehicle and a second position in which the device is configured to space the vehicle cover apart from the vehicle; and a control device in fluid communication with the inlet and configured to be in fluid communication with the source of pressurized fluid, the control device being controllable to direct the pressurized fluid into and out of the chamber to selectively move the lift member between the first position and the second position.

12. The device of claim 11 wherein the structural member contacts the ground.

13. The device of claim 11 wherein the structural member is coupled to a docking structure for a boat and the vehicle cover is constructed to receive at least a portion of the boat.

14. The device of claim 11 wherein the structural member is constructed to rest on a bottom of a body of water and the vehicle cover is constructed to receive at least a portion of a boat.

15. The device of claim 11 further comprising a boat lift for raising a boat from a body of water, the structural member being coupled to the boat lift and the vehicle cover being constructed to receive at least a portion of the boat.

16. The device of claim 11 wherein the structural member further comprises first and second ends, the first end having an elongated hollow extending at least partially from the first end to the second end and ending at a termination point, the hollow having an internal wall having an at least substantially constant cross-sectional shape.

17. The device of claim 11 wherein the structural member further comprises top and bottom ends, the top end having an elongated hollow extending vertically downward at least partially from the top end to the bottom end and ending at a termination point, the hollow having an internal wall having an at least substantially constant, circular cross-sectional shape.

18. The device of claim 11 wherein the inlet is configured to receive pressurized water.

19. A device for covering a vehicle, the device comprising:

a protective cover having a perimeter and a lower surface constructed to receive at least a portion of the vehicle;

a plurality of pistons arranged to support the protective cover at a plurality of points about the perimeter, the pistons each comprising a structural member and a lift member, the structural member having an internal chamber and an inlet in fluid communication with the internal chamber, the lift member having a top end coupled with the protective cover and a bottom end reciprocally engaged with the chamber in the structural member, the chamber being substantially separated from an external environment by the chamber and the bottom end of the lift member, and the lift member being movable with the protective cover between a lowered position in which the protective cover receives at least a portion of the vehicle within the lower surface and a raised position in which the protective cover is removed from the vehicle; and a control device in fluid communication with the inlet and being controllable to direct the pressurized fluid into and out of the chamber to move the lift members between the raised position and the lowered position.

20. The device of claim 19 wherein the protective cover further comprises a rigid frame and a pliable sheet, the rigid frame being constructed to closely receive at least the top portion of the vehicle from above, and the pliable sheet being attached to the rigid frame to shelter the vehicle from the elements when the lift member is in the lowered position.

21. The device of claim 19 wherein the protective cover further comprises a rigid frame and a pliable sheet, the rigid frame being constructed to closely receive at least the top portion of a boat from above, and the pliable sheet being attached to the rigid frame to protect the boat when the lift member is in the lowered position.

22. The device of claim 19 wherein the inlet is configured to be selectively coupled to a water faucet such that the device operates using pressurized water.

23. A method for moving a protective cover with respect to a vehicle, the method comprising:

coupling a pressurized water supply to a substantially sealed chamber created between a hollow in a first structural member and a piston head on a second structural member reciprocally engaged therewith; and actuating a valve assembly to selectively cause the water to enter and exit the chamber and move the second structural member along with the protective cover between a first position in which the vehicle is covered and a second position in which the cover is separated from the vehicle.

24. The method of claim 23 further comprising actuating the valve assembly to discharge the pressurized fluid from the chamber and cause the second structural member to move from the second position to the first position.

25. The method of claim 23 wherein the protective cover is configured to closely receive a boat.

* * * * *